United States Patent [19]

Louw

[11] Patent Number: 4,727,995

[45] Date of Patent: Mar. 1, 1988

[54] CRANE WITH PIVOTAL BOOM

[75] Inventor: Franklin S. Louw, Wychwood, South Africa

[73] Assignee: Peter Povall, Bedfordview, South Africa

[21] Appl. No.: 843,650

[22] Filed: Mar. 25, 1986

[30] Foreign Application Priority Data

Apr. 10, 1985 [ZA] South Africa ..... 85/2658

[51] Int. Cl.[4] ..... B66C 23/44

[52] U.S. Cl. ..... 212/180; 212/261; 212/264

[58] Field of Search ..... 212/175, 180, 255, 260, 212/261, 264, 265, 266, 267, 268; 414/496, 685, 560, 912

[56] References Cited

U.S. PATENT DOCUMENTS

| | | | |
|---|---|---|---|
| 3,044,196 | 7/1962 | Kinney | 212/261 |
| 3,059,785 | 10/1962 | Buckeye | 212/261 |
| 3,275,296 | 9/1966 | Meyer | 212/261 |
| 3,471,033 | 10/1969 | Prury | 212/260 |
| 4,226,331 | 10/1980 | Dumond | 212/261 |

FOREIGN PATENT DOCUMENTS

| | | | |
|---|---|---|---|
| 35636 | 1/1966 | Finland | 212/261 |

OTHER PUBLICATIONS

Servis, Parts Catalog, Gold Star Post Hole Digger and Utility Crane, 3rd Ed. 6-5-75.

*Primary Examiner*—Sherman D. Basinger
*Assistant Examiner*—Stephen P. Avila
*Attorney, Agent, or Firm*—Browdy and Neimark

[57] ABSTRACT

A tractor crane includes a boom having a root end adapted for pivotal mounting on a tractor, a load end which is adjustable in position relative to the root end, strut connector intermediate its ends, and load attachment device at or near the load end of the boom for attaching a load thereto. The crane further includes a strut having an upper end pivotally connected via the strut connector to the boom about an axis transverse to the boom and parallel to the pivotal axis at the root end. The strut also has a lower end with a mounting device for connection of the lifting arms of the three-point hitch of the tractor.

6 Claims, 6 Drawing Figures

CRANE WITH PIVOTAL BOOM

BACKGROUND OF THE INVENTION

This invention relates to a crane.

The applicant is aware of a tractor crane which includes a boom having a root end pivotally mounted on a tractor and having a load end with load attachment means opposite the root end; and a strut of inverted U-shape supporting the boom intermediate its ends, and having its arms connected to the lifting arms of the three-point hitch of the tractor.

The applicant believes that a tractor crane according to the invention will be more versatile than the one of which he is aware.

SUMMARY OF THE INVENTION

According to the invention, there is provided a tractor crane which includes a boom having a root end adapted for pivotal mounting on a tractor, a load end which is adjustable in position relative to the root end, and strut connecting means intermediate its ends;

load attachment at or near the load end of the boom for attaching a load thereto; and A strut having an upper end pivotally connected via the strut connecting means to the boom about an axis transverse to the boom and parallel to the pivotal axis at the root end, and having a lower end with mounting means for connection to the lifting arms of the three-point hitch of the tractor.

The adjustability in position of the load end relative to the root end of the boom may be provided by having the boom in at least two parts of approximately equal length, namely a load end part and a root end part, the said parts being connected together by a joint permitting the load end part to be out of alignment with the root end part by being at an angle thereto. The adjustability in position of the load end part relative to the root end part may further be provided by having the load end part of the boom constituted by at least two telescopic parts so as to enable the overall length of the load end part of the boom to be varied.

Alternatively, the adjustability in position of the load end relative to the root end may be provided by having the boom itself constituted by at least two telescopic parts, so as to enable the overall length of the boom to be varied.

The telescopic parts may be lockable in position relative to each other at varying degrees of overlap by having removable bolts or pins passing through registering holes in the telescopic parts.

The boom may be of generally oval tubular section arranged so that in use the direction of the load is transverse to the greatest depth of section of the boom. The strut connecting means of the boom may include a plurality of spaced pivotal mountings to accommodate the upper end of the strut at various alternative spacings from the boom pivotal axis at its root end. The strut may be of an inverted T-shape, the transverse bar of the T-shape being the lower end of the strut with the mounting means at its ends.

There may be provided a pair of lateral stays connected to and converging towards the boom from positions on either side of and spaced laterally from the pivotal mounting of the boom at its root end. The stays may include turn-buckles with right and left hand threads for adjusting their lengths. The stays ensure lateral stability of the boom.

The load attachment means may include a pair of prongs projecting upwardly in use and closely spaced laterally so as to accommodate the thickness of a link of a load chain for instant locking.

BRIEF DESCRIPTION OF THE DRAWINGS

The invention will now be described by way of example with reference to the accompanying diagrammatic drawings.

In the drawings.

DESCRIPTION OF THE EMBODIMENTS

Figure 1:
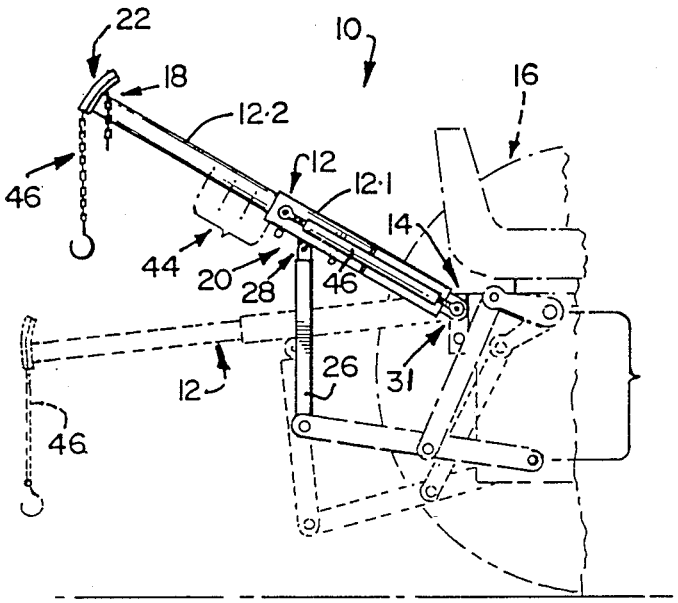
FIG. 1 shows a side elevation of one embodiment of a crane in accordance with the invention, in position on the three-point hitch of a tractor.

Referring to the drawings, reference numeral 10 refers generally to a tractor crane which includes a boom 12 having a root end 14 adapted for pivotal mounting on a tractor 16, a load end 18 which is adjustable in position relative to the root end 14, and strut connecting means 20 intermediate its ends 14 and 18; and load attachment means 22 at or near the load end 18 of the boom 12 for attaching a load 24 thereto. The crane 10 further includes a strut 26 having an upper end 28 pivotally connected via the strut connecting means 20 to the boom 12 about an axis 29 transverse to the boom 12 and parallel to the pivotal axis 31 at the root end 14. The strut 26 further has a lower end 32 with mounting means 34 for connection to the lifting arms 30 of the three-point hitch 38 of the tractor 16.

The adjustability in position of the load end 18 relative to the root end 14 of the boom 12 is provided by having the boom in at least two parts 12.1 and 12.2 of approximately equal length, namely a load end part 12.2 and a root end part 12.1, the said parts being connected together by a joint 40 permitting the load end part 12.2 to be out of alignment with the root end part 12.1 by being at an angle 42 or 42.1 or any other convenient angle thereto. Thus, the angle of attack of the load end part 12.2 may be varied relative to the root end part 12.1.

The adjustability in position of the load end part 12.2 relative to the root end part 12.1, is further provided by having the load end part 12.2 of the boom constituted by at least two telescopic parts 12.21 and 12.22 so as to enable the overall length of the load end part 12.2 of the boom 12 to be varied.

The adjustability in position of the load end 18 relative to the root end 14, is provided by having the boom 12 itself constituted by at least two telescopic parts 12.1 and 12.2 without an intervening joint 40, so as to enable the overall length of the boom to be varied.

The telescopic parts 12.1 and 12.2 are lockable in position relative to each other at varying degrees of overlap by having removable bolts or pins passing through registering holes in the telescopic parts, as indicated by centre lines 44.

The boom 12 is of generally oval tubular section, as shown, and is arranged so that in use the direction of the load along load element 46 is transverse to the greatest depth of section of the boom 12. The strut connecting means 20 of the boom 12 includes a plurality of spaced pivotal mountings 20.1, 20.2, 20.3 to accommodate the upper end 28 of the strut 26 at various alternative spacings from the boom pivotal axis 31 at its root end 14. The strut 26 is of an inverted T-shape, the transverse bar 26.1 of the T-shape being the lower end of the strut with the mounting means 34 at its ends. There is provided a pair of lateral stays 46, 48 with turn-buckles. The stays are connected to and converge towards the boom 12 from positions on either side of and spaced laterally from the pivotal mounting of the boom 12 at its root end 14.

The load attachment means 22 includes a pair of prongs 22.1 and 22.2 projecting upwardly in use, and closely spaced laterally to define a gap 50 between them. A link 52 of a load chain 46 is received into the gap 50 and is held locked by the link 56 bearing against the backs of the prongs 22.1 and 22.1.

Figure 5:
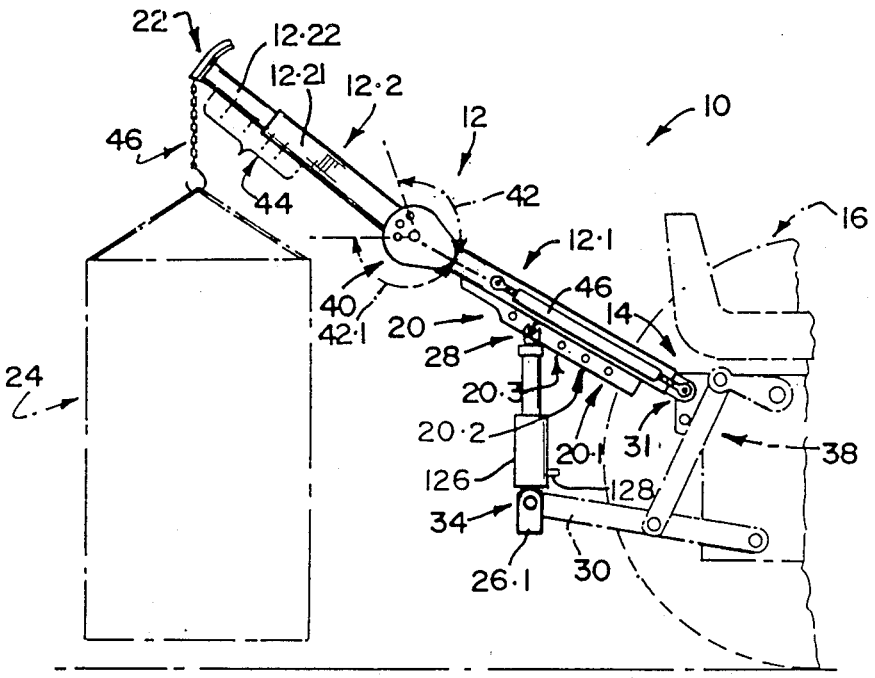
FIG. 5 shows a side elevation of a further embodiment of a crane according to the invention.

Referring to FIG. 5 of the drawings, there is shown an alternative construction in which the strut 126 is a hydraulically extendable strut having connecting means 128 for connection to a supply of hydraulic fluid under pressure, say, from the tractor 16. For this purpose, the connecting means will incorporate a quick coupling connection. By making use of a crane according to the invention with a hydraulically extendable strut 126, an increased lift is obtained beyond that obtainable with a strut 26.

Figure 2:
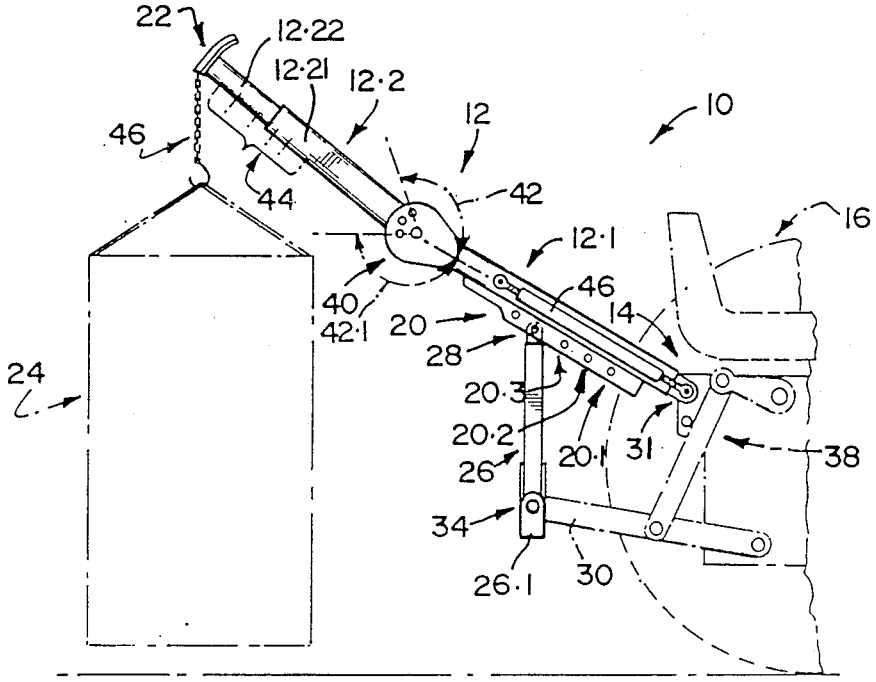
FIG. 2 shows a side elevation of another embodiment of a crane in accordance with the invention, also in position on the three-point hitch of a tractor.
Figure 3:
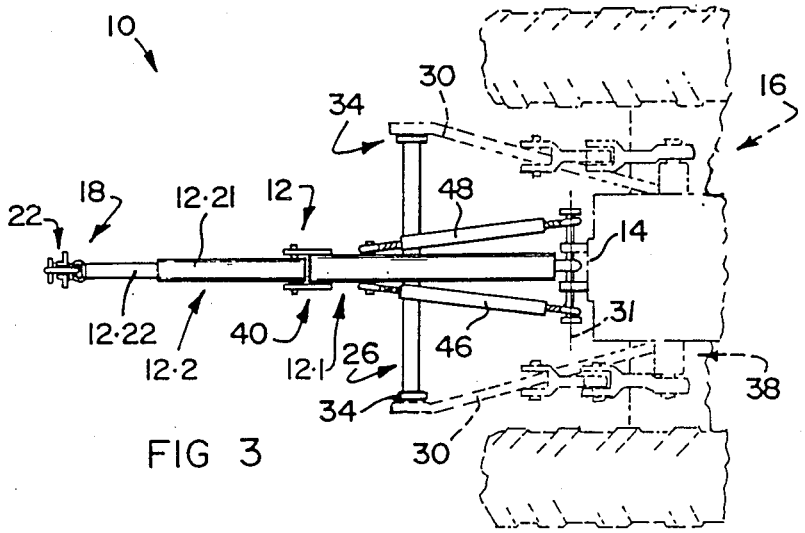
FIG. 3 shows a plan view corresponding to FIG. 2.
Figure 4:
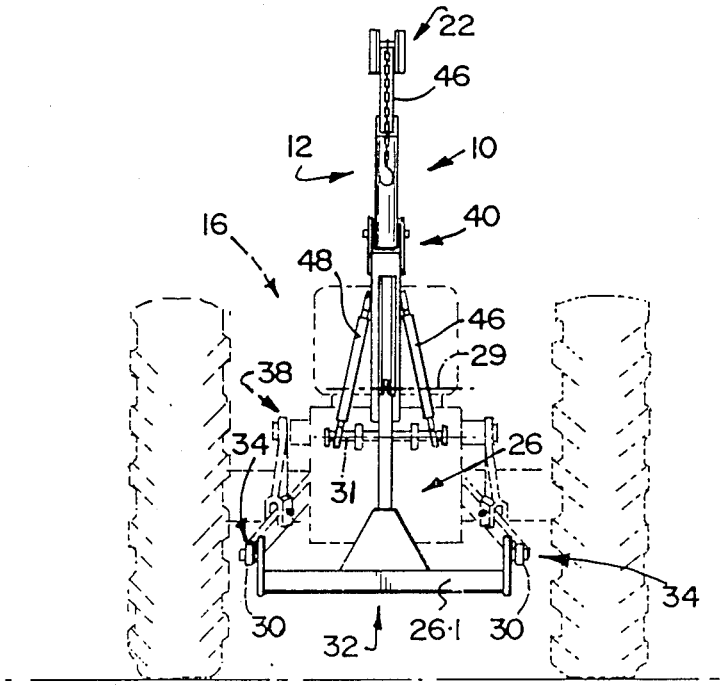
FIG. 4 shows a rear elevation corresponding to in FIG. 2.
Figure 6:
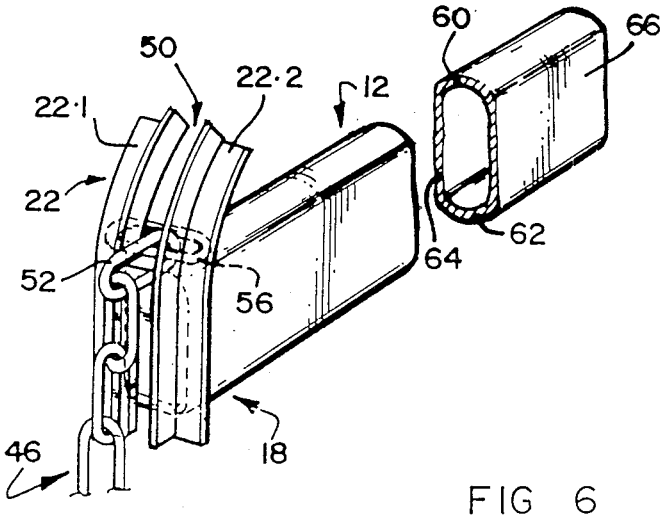
FIG. 6 shows a three-dimensional view of the load attachment means at the load end of the boom.

The boom 12 and the other parts may conveniently be made of fabricated tubular section having a wall thickness of 6 mm. Thus it has been found that a tubular section having dimensions 150 mm×50 mm can be used for the root end part 12.1. A tubular section having dimensions of 135 mm×35 mm can form the load end part 12.1 and can slide inside the root end part 12.1 to provide for telescopic adjustment. Similarly, the tubular section as discussed could also be used for the telescopic load end part 12.2 of the embodiment shown in FIG. 2. The tubular section of a boom 12 may be fabricated from upper and lower half-round tubular parts 60 and 62 joined by laterally spaced side plates 64 and 66 (see FIG. 6).

It is an advantage of this invention that it is versatile in that it can be used to lift a large variety of loads. It can be of particular use in off-loading and loading heavy equipment onto the loading platform of a load vehicle. The applicant believes that the invention will find many uses on a farm.

What I claim is:

1. A tractor crane which includes a boom having a root end adapted for pivotal mounting on a tractor, a load end which is adjustable in position relative to the root end, and strut connecting means intermediate its ends, and stays connected to and diverging laterally away from the boom on either side of the boom, the stays having connecting means at their ends remote from their connection to the boom for pivotal connection to the tractor to provide lateral stability in use to the boom;

load attachment means at or near the load end of the boom for attaching a load thereto; and a strut having an upper end pivotally connected via the strut connecting means to the boom about an axis transverse to the boom and parallel to the pivotal axis at the root end, and having a lower end with mounting means for connection to the lifting arms of the three-point hitch of the tractor.

2. A crane as claimed in claim 1, in which the pivotal connection of the pair of lateral stays to the tractor is coaxial with the pivotal mounting of the boom at its root end.

3. A crane as claimed in claim 1, in which the load attachment means includes a pair of prongs projecting upwardly in use and closely spaced laterally and defining a gap between them so as to accommodate the thickness of a link of a load chain for instant locking.

4. A tractor crane which includes a boom having a root end adapted for pivotal mounting on a tractor, a load end which is adjustable in position relative to the root end, and strut connecting means intermediate its ends, the said strut connecting means of the boom including a plurality of spaced pivotal mountings to accommodate the upper end of the strut at various alternative spacings from the boom pivotal axis at its root end;

load attachment means at or near the load end of the boom for attaching a load thereto; and a strut having an upper end pivotally connected via the strut connecting means to the boom about an axis transverse to the boom and parallel to the pivotal axis at the root end, and having a lower end with mounting means for connecting to the lifting arms of the three point hitch of the tractor,the strut being of an inverted T-shape and the transverse bar of the T-shape being the lower end of the strut with the mounting means at its ends.

5. A tractor crane which includes a boom having a root end adapted for pivotal mounting on a tractor, a load end which is adjustable in position relative to the root end, and strut connecting means intermediate its ends;

load attachment means at or near the load end of the boom for attaching a load thereto and including a pair of prongs projecting upwardly in use and closely spaced laterally and defining a gap between them so as to accommodate the thickness of a link of a load chain for instant locking; and a strut having an upper end pivotally connected via the strut connecting means to the boom about an axis transverse to the boom and parallel to the pivotal axis at its root end, and having a lower end with mounting means for connection to the lifting arms of the three point hitch of the tractor.

6. A crane as claimed in claim 5, in which the adjustability in position of the load end relative to the root end of the boom is provided by having the boom in at least two parts of approximately equal length, namely a load end part and a root end part, the said parts being connected together by a joint permitting the load end part to be outof alignment with the root end part by being at an angle thereto.

* * * * *